United States Patent [19]

Lawrence

[11] 4,026,540

[45] May 31, 1977

[54] SELECTIVE TRAY SHEET SORTING MACHINE

[76] Inventor: Frederick J. Lawrence, 801 Miramar Ave., San Francisco, Calif. 94112

[22] Filed: June 10, 1975

[21] Appl. No.: 585,686

[52] U.S. Cl. ..... 271/173; 271/64
[51] Int. Cl.[2] ..... B65H 29/60
[58] Field of Search ..... 271/64, 173; 270/58

[56] References Cited

UNITED STATES PATENTS

| | | | |
|---|---|---|---|
| 2,919,917 | 1/1960 | Worswick | 270/58 |
| 3,879,032 | 4/1975 | Shirahase | 271/173 |

*Primary Examiner*—Robert W. Saifer
*Attorney, Agent, or Firm*—Newton H. Lee, Jr.

[57] ABSTRACT

A sheet sorting machine has a double set of sheet receiving trays and deflector fingers for selectively deflecting successive sheets into alternate trays in the set.

8 Claims, 12 Drawing Figures

SELECTIVE TRAY SHEET SORTING MACHINE

BACKGROUND OF THE INVENTION

Sheet sorting machines of the type disclosed in my prior Application for United States Letters Patent, Ser. No. 506,526 filed Sept. 16, 1974, now U.S. Pat. No. 3,937,459, granted Feb. 10, 1976, involved the use of a sheet transport means which is adapted to transport sheets successively through a path past a series or stack of spaced trays or bins into which the sheets are deflected by suitable deflector means. Such deflector means have typically been in the form of fingers or gates acuatable between open positions, at which a sheet is allowed to pass by and closed positions at which a sheet is deflected from the transport mechanism into a selecteed bin or tray, tray.

In order to provide a sufficient number of bins or trays to sort large numbers of copies, a number of approaches have been taken, including enlarging the number of trays or bins in a given stack and increasing, correspondingly, the number of deflectors or gates or providing a modular structure in which a number of stacks of bins or trays are assembled in cooperative relation and means are provided for directing sheets to successive modules.

While either of the above prior approaches to the problem of increasing the capacity of sheet sorting apparatus is to some extent satisfactory, each approach involves inherent space problems.

SUMMARY OF THE INVENTION

The present invention provides sheet sorting apparatus in which the sheet sorting capacity of the apparatus may be doubled without enlarging the overall size of the apparatus.

In accomplishing the foregoing, the present invention contemplates utilizing a number of sheet receiving bins or trays in which alternate bins or trays are adapted to receive successive sheets in response to adjustment of the sorting machine.

More particularly, the sorting apparatus is such that there is a first set of bins or trays adapted to receive successive sheets fed by the transport mechanism to the diverting means or gates and a corresponding number of bins or trays in a second set adapted to receive an additional number of sheets deflected from the transport mechanism into the successive bins or trays of the second set. This is accomplished without necessarily enlarging the overall size of the apparatus; this is to say that apparatus capable of sorting ten copies according to my present pending Application, can be simply adapted to sort twenty copies according to the present invention.

The sheet deflector finger means in accordance with my prior Application provides a sheet path past which the transport mechanism carries successive sheets with the sheets confined in the path against curling or edgewise engaging the deflecting fingers when the fingers are closed, and when the fingers are open, the fingers have supporting body portions which direct the successive sheets into the bins or trays arcuately and upwardly, above previously stacked sheets within the bins or trays. The present invention involves the concept of multiplying or doubling the number of trays and selectively adjusting the relationship between the trays and the portions of the fingers, or the finger supporting body which directs the sheets into the trays.

In a preferred form the trays are doubled in number and the fingers are constructed so as to have sheet guiding portions adjustable to direct a sheet into either of a pair of adjacent trays. Also, within the purview of the invention, the fingers as a whole may be adjusted with respect to the trays so as to direct them into either of a pair of adjacent trays. Another alternate mode of accomplishing the advantages of the invention involves adjusting the relationship of the trays relative to the fingers, so that the fingers can deflect sheets into either of a pair of adjustable trays.

This invention possesses many other advantages, and has other purposes which may be made more clearly apparent from a consideration of the forms in which it may be embodied. These forms are shown in the drawings accompanying and forming part of the present specification. They will now be described in detail, for the purpose of illustrating the general principals of the invention; but it is to be understood that such detailed descriptions are not to be taken in a limiting sense.

DESCRIPTION OF THE PREFERRED EMBODIMENT

Figure 1:
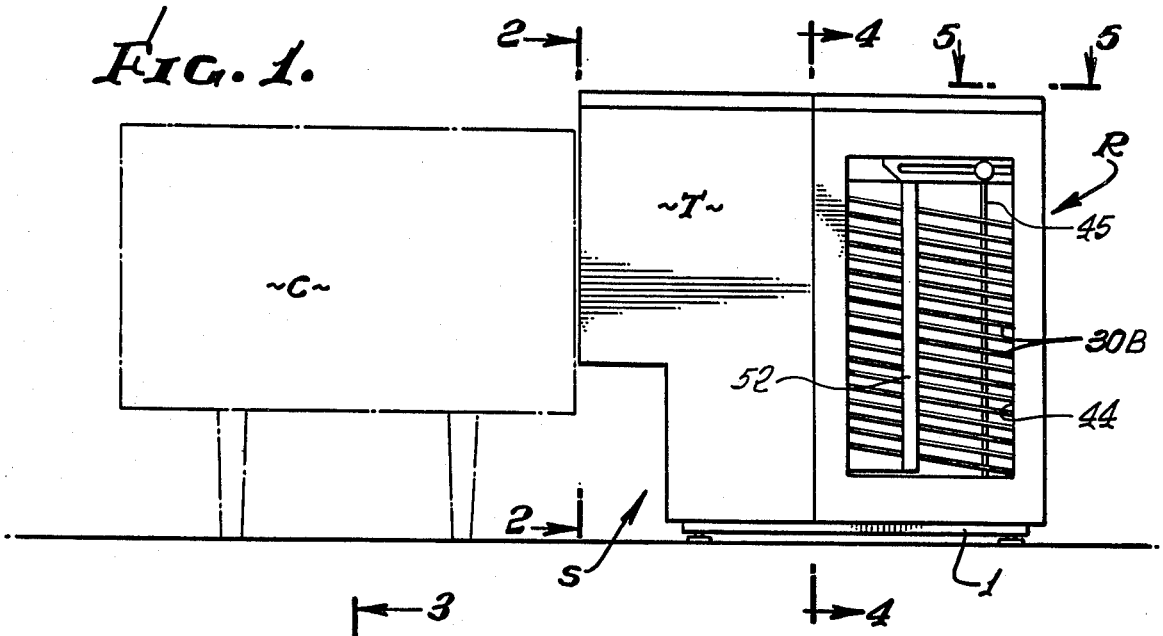
FIG. 1 is a side elevation of the sorting machine disposed adjacent to a typical copying machine shown in broken lines.
Figure 2:
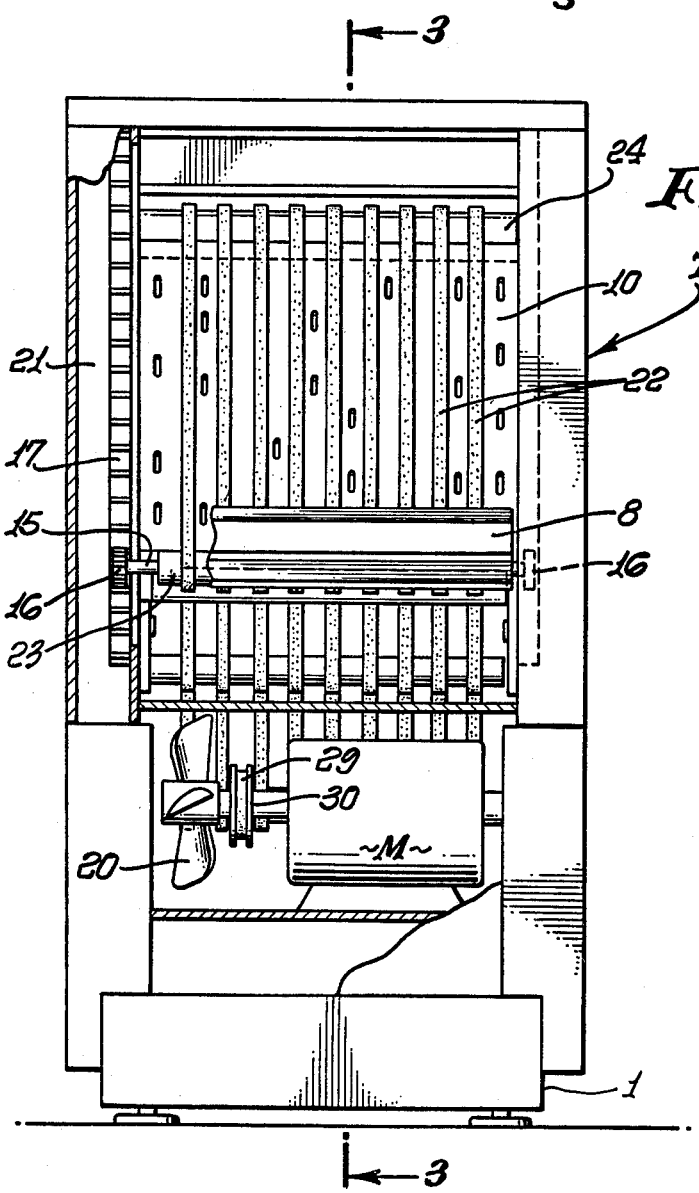
FIG. 2 is an enlarged view, as taken on the line 2—2 of FIG. 1, with portions broken away.

As seen in the drawings, a sorting machine S, made in accordance with the invention, comprises a base support 1 adapted to be placed adjacent to a source of sheets to be sorted, such as a copying machine C, shown in broken lines in FIG. 1, so that sheets can be supplied to a transport section T of the sorter and carried to the receiver section R of the sorter.

The base 1 includes a main frame 2 having side rails 3 on which slide means 4 (FIG. 4) support the receiver section R for movement away from the transport section T, upon release of latch means 5 (best seen in FIG. 3), which normally hold the sections together during operation. The slide means 4 also support the transport section T and the receiver section R for movement as a unit, when the latch means 5 are engaged, towards and away from the copier or source C on the fixed base 1.

The transport section T may be of various types, but is shown as that disclosed in my above-identified Application and has within a suitable case a vacuum chamber V defined by the side walls of the case, a rear wall 6 and an adjustable vacuum chamber section 7 which is adapted to be shifted vertically to dispose an inlet member 8 at a selected elevation. This enables the transport section to be associated with copiers or other sources which have sheet supply outlets at different elevations.

Figure 3:
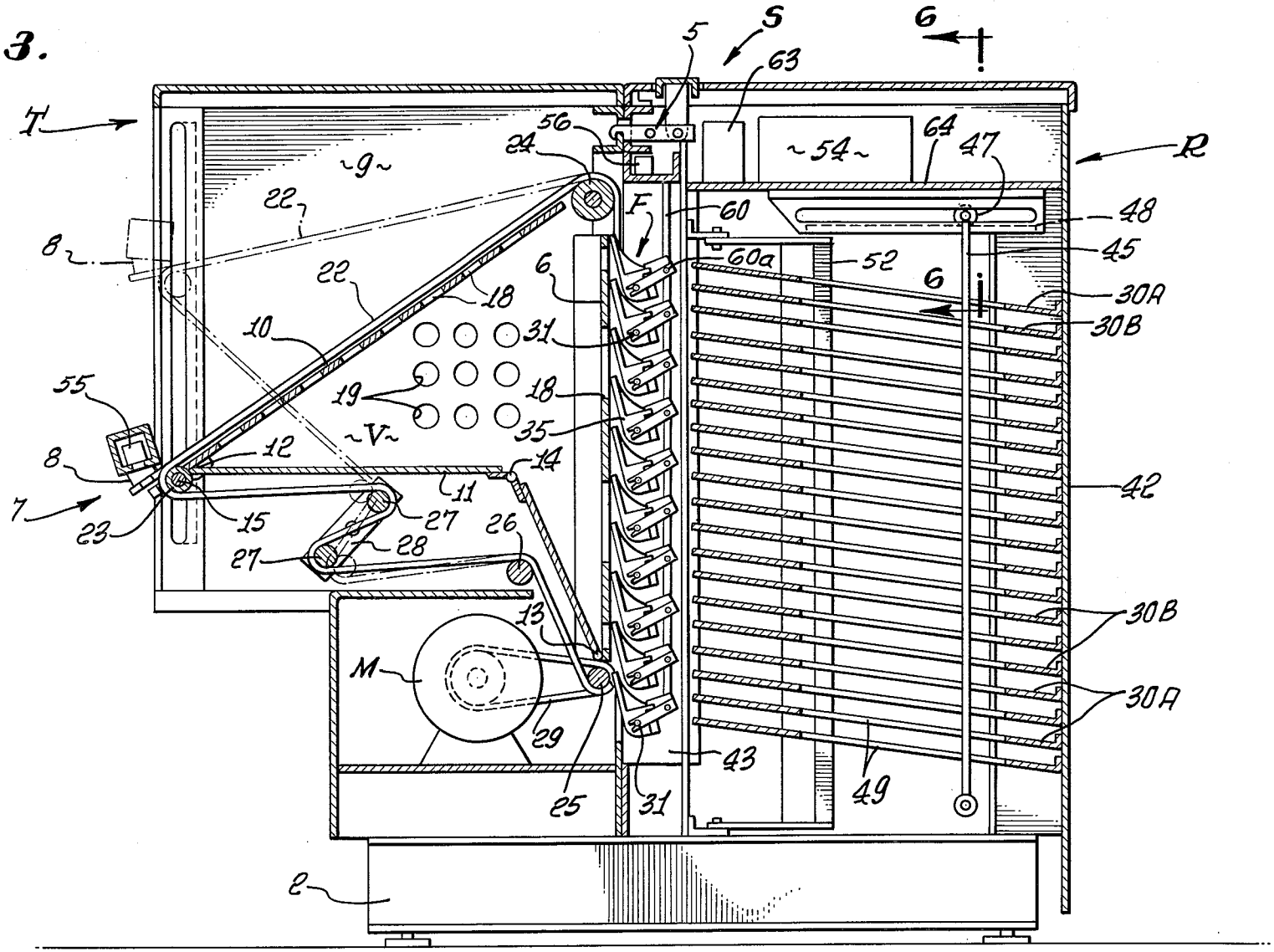
FIG. 3 is a vertical section as taken on the line 3—3 of FIG. 2.
Figure 4:
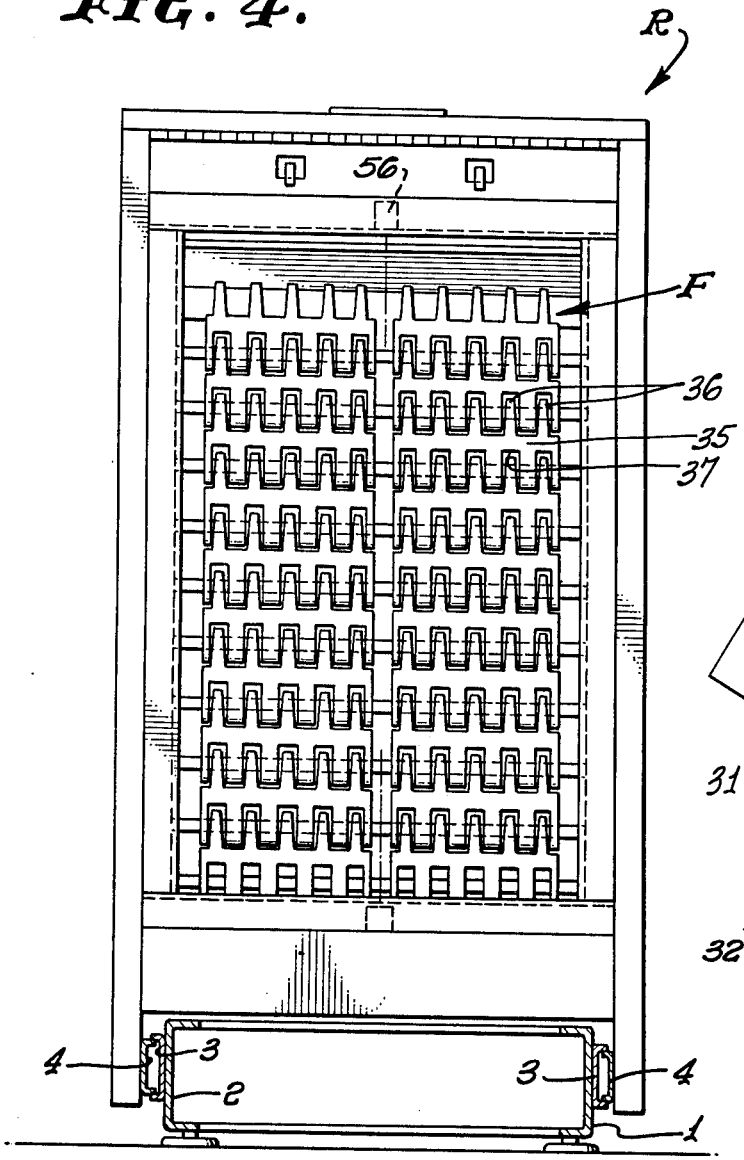
FIG. 4 is a vertical section as taken on the line 4—4 of FIG. 1.

The rear wall 6 is affixed between the side walls 9 of the case and the vertically adjustable section 7 of the vacuum chamber includes an upper plate or wall 10, which is suitably pivotally mounted between the side walls 9, at a point above the rear wall 6, for movement throughout a range of positions, including the full line and broken line positions of FIG. 3. An articulated lower wall 11 of the adjustable chamber section 7 is connected to the upper walls 10 at 12 and is pivotally connected at 13 to the rear wall 6, the wall 11 having a pivotal joint 14 between the connections 12 and 13 to enable the upper wall 10 to be moved through its range of adjustment.

A shaft 15 is disposed beneath the front side of the plate 10 and has pinions 16 at its ends engaged with equalizing racks 17 vertically supported in the case, whereby the inlet 8 is maintained in horizontal relation throughout its range of movement.

The top wall 10 and the rear wall 6 of the vacuum chamber V have suitable perforations or slots 18, and a side wall 9 has perforations or openings 19 whereby air is drawn into the chamber V through the perforations 18 and from the chamber through the perforations 19 by a suitable fan 20 driven by an electric motor M. The side wall of the housing provides a vertically extended chamber 21 exhausted by the fan 20 to cause the evacuation of the chamber V.

Extended about the chamber V is a number of laterally spaced sheet transporting belts 22. These belts extend in slightly spaced relation to the chamber walls about a front roller 23 revolvable about the shaft 15 at the paper inlet 8, a top roller 24 at the upper end of the top wall 10, a lower drive roller 25, beneath the chamber V, an idler roller 26, and a pair of tensioning rollers 27 mounted on a pivotal support 28 which may be biased to maintain tension on the belts 22 while enabling the chamber section 7 to be vertically adjusted. The belts 22 are driven by means of a drive belt 29 extending about a pulley 30 on the shaft of motor M, and the belt drive roller 25.

Accordingly, it will be seen that a sheet of paper supplied to the inlet 8 will be transported on the belts 22, while being held against the belts by reason of the reduced air pressure in the chamber V, upwardly along the upper wall 10 and then downwardly along the inner wall 6.

Sheets are picked off of the belts along the inner wall 6 by finger means F and directed into one of the suitable number of trays depending upon the number of sheets to be sorted. In accordance with the present invention, as now being described, the trays are in sets designated 30A and 30B in a vertically spaced stack. The finger means F are constructed, as will be later described, to selectively direct sheets into either successive trays 30A of the spaced sets or into successive trays 30B, so that twice the number of sorted sheets can be accommodated without increasing the number of finger means.

Figure 7:
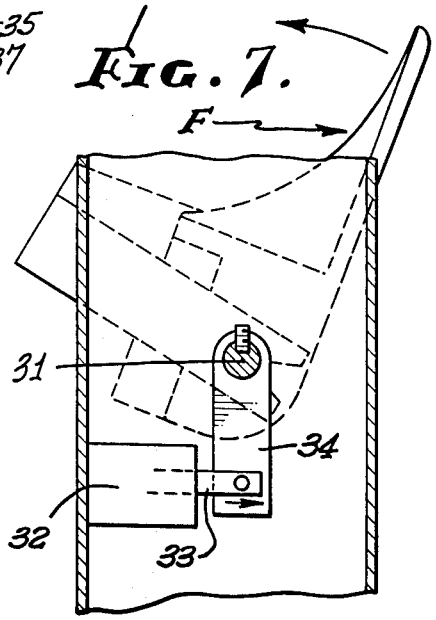
FIG. 7 is a detail view in section showing a typical finger actuator.

The finger means F, in accordance with the invention, comprise a plurality of vertically spaced compound finger units mounted upon horizontal shafts 31, each of which, as seen in FIG. 7, is rockable by a suitable solenoid 32 having its armature 33 connected with a crank 34 fixed on the shaft 31. The solenoid 32 is adapted to actuate the finger units between open and closed positions. In the open positions, the finger units direct a paper sheet carried by the belts 22 into a tray 30A or 30B, and in the closed position these finger units allow a sheet to pass by for engagement with a lower open finger unit. In the preferred form, the solenoids are such that the fingers are normally open and are actuated to the closed position.

Figure 8:
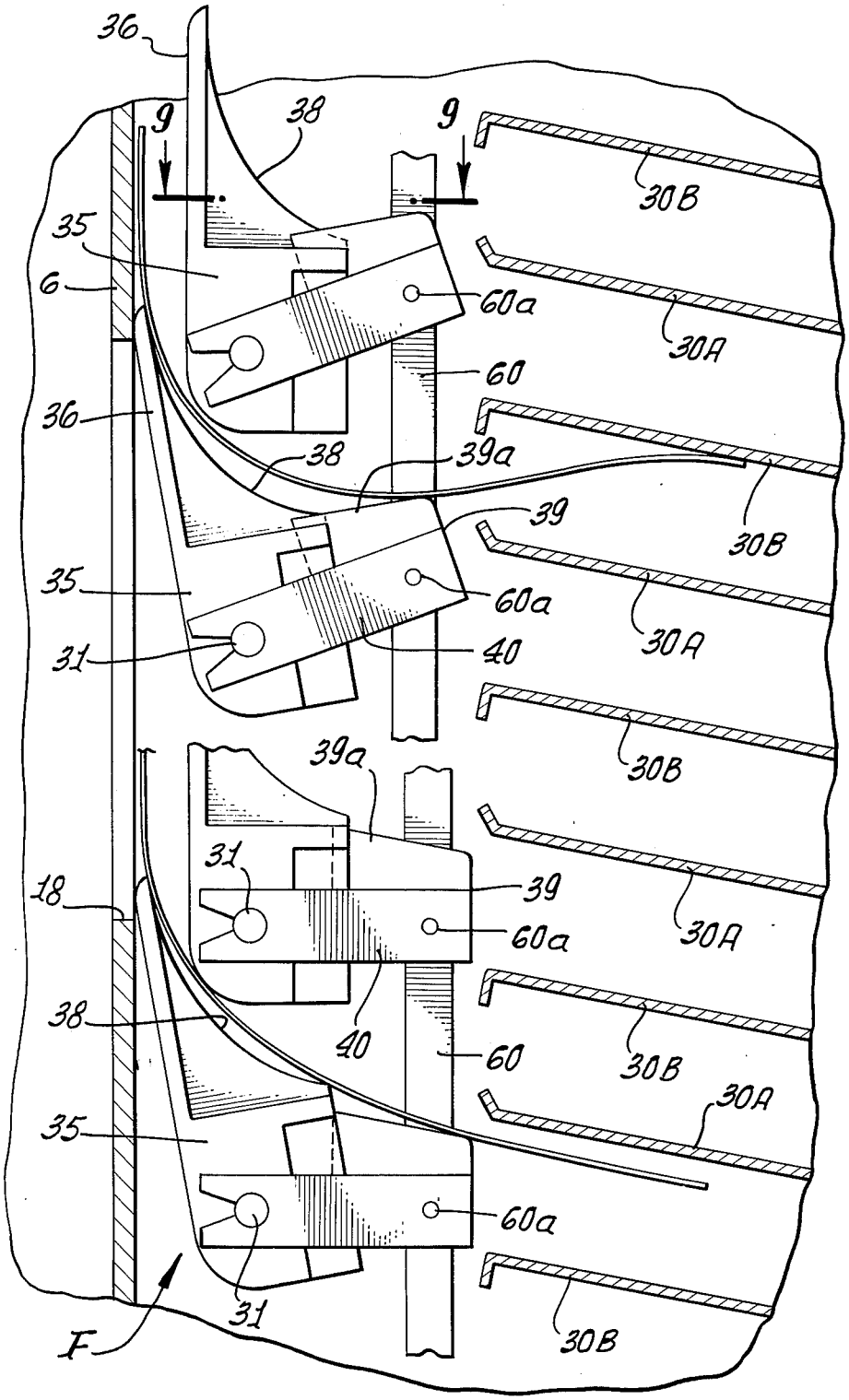
FIG. 8 is an enlarged fragmentary detail view showing the finger and tray arrangement and mode of operation.

The respective finger units F comprise a body 35 of molded plastic fixed on the rock shaft 31 so as to be pivotal with the shaft, as seen in FIG. 7 and 8, between the open and closed positions. Extending upwardly from the body 35 is a plurality of laterally spaced fingers 36. The respective bodies 35 have laterally spaced notches or recesses 37 into which the fingers of a subjacent unit project when the fingers are closed, whereby the interfitting fingers and bodies afford an overall substantially smooth, flat, vertical surface, without corners or rough edges, so that a sheet traveling downwardly on the belts will not impinge upon or become jammed with the closed finger units. The fingers 36 have a curved sheet engaging guide surface 38 extending downwardly and inwardly towards the trays.

Figure 9:
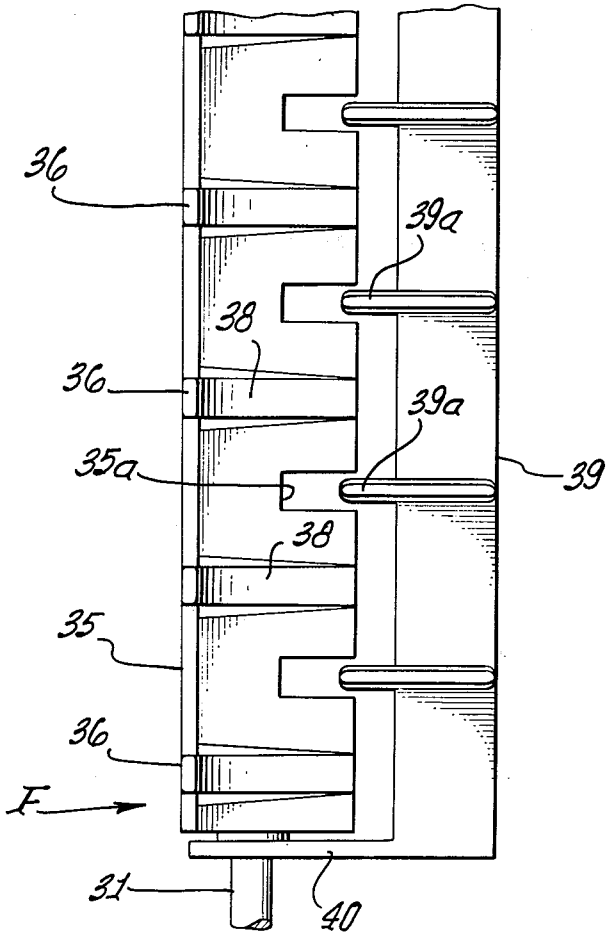
FIG. 9 is a fragmentary horizontal section, as taken on the line 9—9 of FIG. 8.

As best seen in FIGS. 8 and 9, the fingers are of a compound structure including an elongated finger end bar 39 having arms 40 at opposite ends which pivotally support the bar 39 on the rock shaft 31 for adjustment between first and second positions relative to the finger body 35, to direct sheets to either a tray or bin 30A or 30B, depending upon the number of copies to be sorted. The bar 39 has upwardly projecting laterally spaced guide fins or webs **39*a*, which project rearwardly into notches 35*a* in the finger body 35 between the arched guide surfaces 38. The spacing of the fins 39*a* and guides 38 is such that a substantially continuous paper guide is provided to direct sheets into the trays in either position of the bar 39**, as will be later described.

Figure 10:
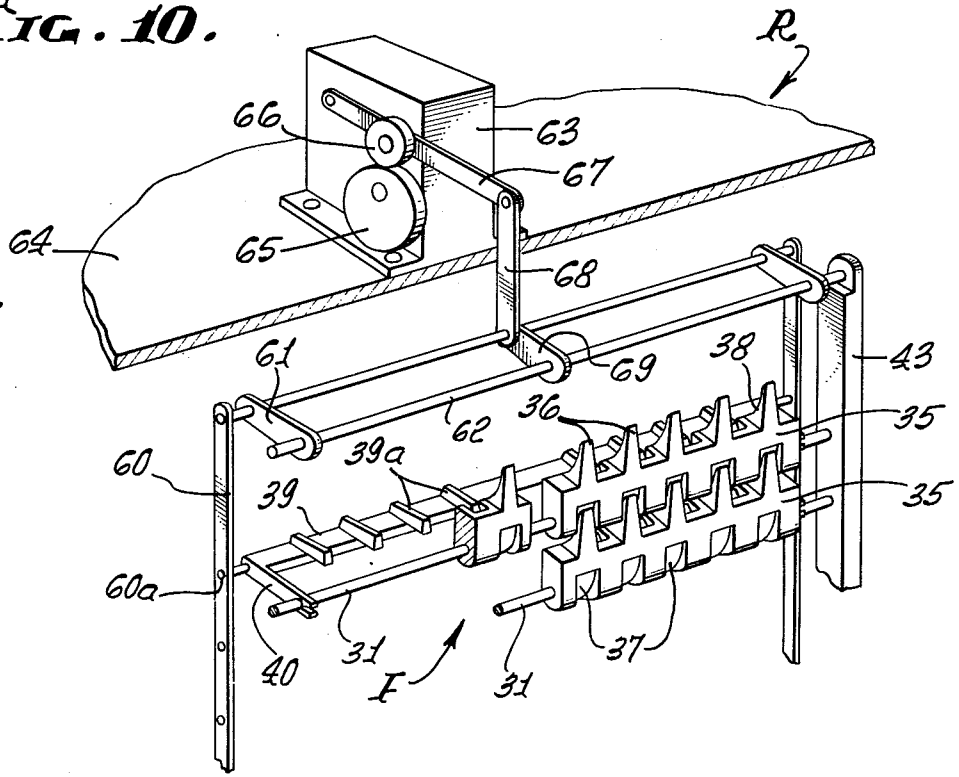
FIG. 10 is a perspective view diagrammatically illustrating the compound finger support and operating means.

Extending vertically at opposite ends of each finger bar 39 is a link 60 pivotally connected at **60*a* to the bars for actuating the bars between their first and second positions shown in FIG. 8. These links, as seen in FIG. 10, are connected at their upper ends to crank arms 61 which are fixed on a rock shaft 62 supported at the top of the side rails 43** of the frame structure.

Actuator means are provided for rocking the shaft 62, including a suitable gearhead motor 63 mounted on a top plate 64 within the receiver R. The motor 63 drives a suitable cam 65 which engages a follower 66 carried by a lever arm 67 pivoted on the motor 63. The free end of the lever arm 67 is connected by a link 68 to a crank arm 69 on the rock shaft 62. The cam 65 is shaped so that on each revolution, through the lever 67, link 68, arm 69, shaft 62, arms 61, and links 60, the finger bars are pivotally actuated about the finger supporting shafts 31 between the upper and lower positions with respect to the finger bodies 35, as seen in FIG. 8.

When the bars 39 are in the upper position, the sheets are successively directed into a tray 30A, but when the bars 39 are lowered, the sheets are successively directed to the lower tray 30B of the sets of trays 30A and 30B.

Figure 6:
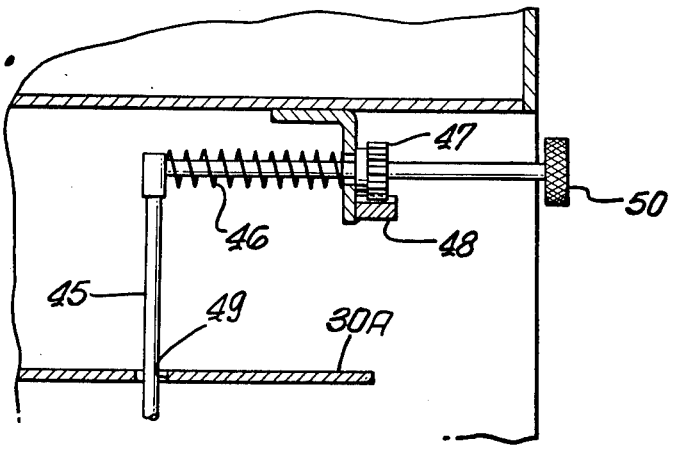
FIG. 6 is a fragmentary vertical section as taken on the line 6—6 of FIG. 3.

As seen in FIG. 3, each tray is mounted on an end wall 42 and on posts 43 of the receiver section and is indented at each side to enable removal of a stack of sheets S from either side through housing openings 44. The trays are adapted to receive sheets of different sizes by means of adjustable stop rods 45 which depend from support arms 46 having pinions 47 engaged with horizontal racks 48 supported at the top of the housing. The rods depend through elongated slots 49 in the trays, so as to be adjustable towards and away from the finger means F by rotation of an operating knob 50, as seen in FIG. 6.

If desired wing side guides 52 may be pivotally mounted on the frame and moved to and from adjusted laterally spaced positions for centering a stack of sheets on the tray.

Figure 5:
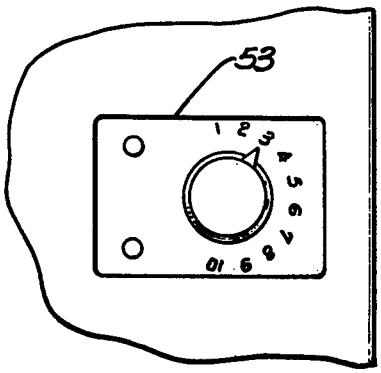
FIG. 5 is a fragmentary top plan as seen on the line 5—5 of FIG. 1.

Suitable electrical controls are provided, including a selector switch 53 (FIG. 5) to select the number of sheets to be sorted. Such controls may be enclosed in a box, such as the box 54 shown in FIG. 3, or elsewhere. Preferably, however, the machine is responsive to a sheet of paper being supplied to the inlet means 8 from the copier or source C. Accordingly, as seen in FIG. 3, a paper sensor 55 is provided at the paper inlet, say in the form of a photo electric cell adapted to turn the sorter on when a sheet is supplied to the inlet and to hold the machine on for a period of time. Under control of the selector switch 53, the fingers are adapted to be successively closed from top to bottom by control means 54, which may be a simple stepping switch, activated by each sheet of paper entering a tray and detected by sensor means such as a photo electric cell 56 located above the fingers. Actuation of the motor 63, to shift the deflector bar means 39 may also be automatic in response to setting of the selector switch 53, say, so that the bars 39 are up for sorting ten sets, and down after ten sets are sorted.

Figure 11:
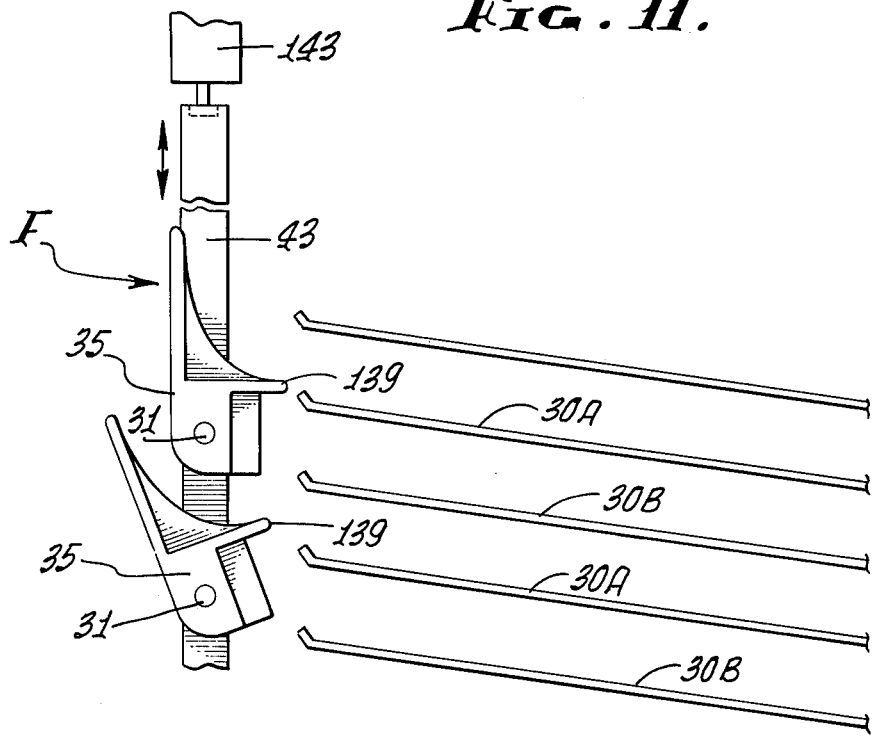
FIG. 11 is a fragmentary vertical section diagrammatically showing a modified arrangement.

Referring to FIG. 11, a modified construction is shown, wherein the guide extensions 139 of the finger bodies 35 are integral with the bodies, only two of which is shown for simplicity. In this form, the supports 43 which carry the finger shafts 31 are adapted to be adjusted vertically and are actuatable between upper, full line, positions and lower, broken line, positions, by suitable means such as a solenoid 143.

Figure 12:
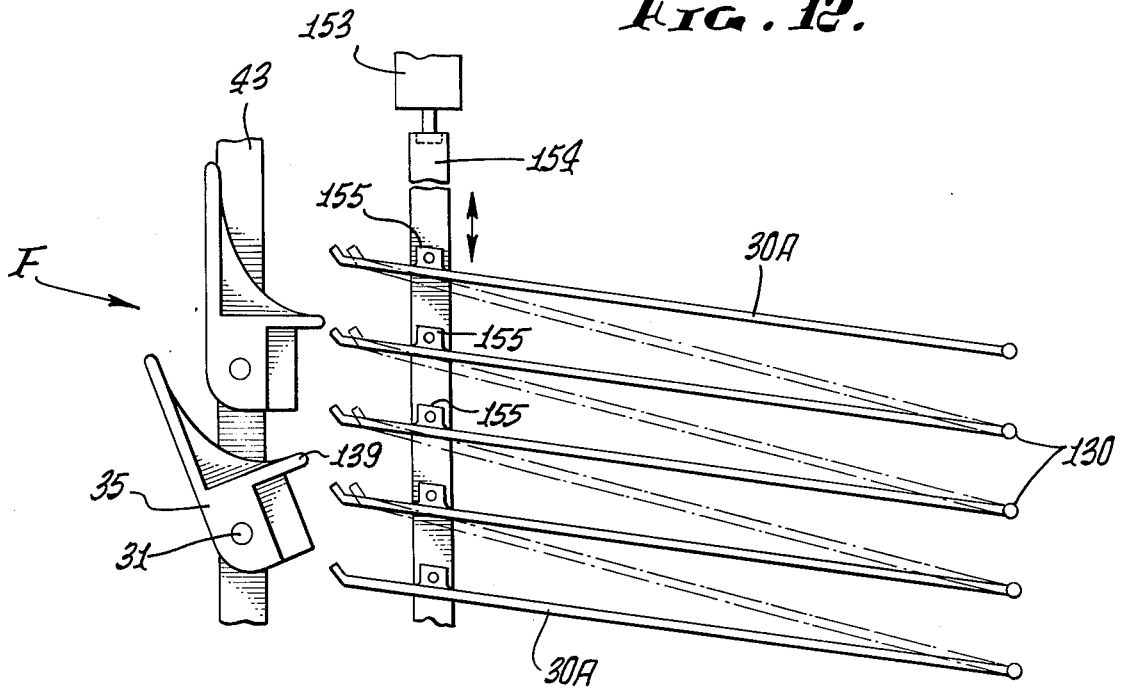
FIG. 12 is fragmentary vertical section diagrammatically showing a further modification.

Referring to FIG. 12, the fingers are like those in FIG. 43, with integral guide ends 139 but the trays of each set, only two complete sets being shown for simplicity, are pivoted at 130 at their ends remote from the fingers and are actuatable between alternate full line and broken line positions by suitable means such as a solenoid 153 connected by a cross bar 154 with vertical links 155 pivotally connected adjacent the input ends of the trays.

It will now be recognized that in each of the above embodiments, the tray sets 30A and 30B and the fingers F are relatively adjusted so that each of the finger units is operative to deflect sheets into selected ones of the tray sets. By virtue of such a construction, the apparatus saves space since separate finger units are not employed for each tray. The cost of manufacture is also, by the same token, minimized.

I claim:

1. In a sorting machine having sheet feeding means including sheet carrying belts, receiver means for successively receiving the sheets from said belts, said receiver means including a stack of sheet receiver trays having input ends past which said belts travel, and finger means actuable between open and closed positions for picking off successive sheets from said belts and directing said sheets into said trays: the improvement wherein said stack of trays includes sets of pairs of trays, and means are provided for adjusting the relationship between said finger means and said sets of trays between first and second conditions in which said finger means alternately successively direct sheets into one of the trays of successive sets.

2. In a sorting machine as defined in claim 1, said fingers, each includes a body supporting said fingers in side by side spaced relation, means supporting said body for pivotal movement to open and close said fingers, deflector means on said body actuatable between first and second positions for deflecting a sheet into alternate trays of said sets, and means for actuating said deflector means between said positions.

3. In a sorting machine, as defined in claim 2, said deflector means comprising a sheet guiding bar pivotally mounted on said body.

4. In a sorting machine, as defined in claim 2, said fingers and said body having an arched surface leading towards said trays, and said deflector means including a bar pivotally mounted on said body and having guides constituting continuations of said arched surfaces.

5. In a sorting machine, as defined in claim 2, said deflector means comprising a sheet guiding bar pivotally mounted on said body, and said means for actuating said deflector means includes links pivotally interconnected with the ends of said bars, and operating means for reciprocating said links.

6. In a sorting machine, as defined in claim 2, said deflector means comprising a sheet guiding bar pivotally mounted on said body, and said means for actuating said deflector means includes links pivotally interconnected with the ends of said bars, and operating means for reciprocating said links, including a motor, a cam driven by said motor, and means between said cam and said links for reciprocating said links upon each revolution of said cam.

7. In a sorting machine, as defined in claim 1, said means for adjusting the relationship between said finger means and the sets of trays includes frame structure supporting said finger means, and means for actuating said frame structure reciprocably with respect to said trays.

8. In a sorting machine, as defined in claim 1, said means for adjusting the relationship between said finger means and the sets of trays includes means pivotally supporting the ends of said trays remote from said finger means, links pivotally interconnected with said trays adjacent said fingers means, and means for reciprocating said links relative to said finger means.

* * * * *